United States Patent [19]

Broughton et al.

[11] Patent Number: 5,007,393

[45] Date of Patent: Apr. 16, 1991

[54] INTEGRAL LIFTING HOOK FOR AN OUTBOARD ENGINE

[75] Inventors: George L. Broughton, Zion, Ill.; Paul W. Breckenfeld, Kenosha, Wis.; David W. Mate, McHenry; James A. Nettles, Round Lake, both of Ill.; Duane E. Rogers, Kenosha, Wis.

[73] Assignee: Outboard Marine Corporation, Waukegan, Ill.

[21] Appl. No.: 525,251

[22] Filed: May 17, 1990

[51] Int. Cl.[5] ..... F02F 7/00

[52] U.S. Cl. ..... 123/195 R; 123/195 P

[58] Field of Search ..... 123/195 P, 195 R, 55 VS, 123/198 R, 193 C

[56] References Cited

U.S. PATENT DOCUMENTS 4,121,557 10/1978 Congram et al. ..... 123/195
4,147,318 4/1979 McDonald ..... 180/64
4,467,754 8/1984 Hayashi et al. ..... 123/195
4,508,072 4/1985 Takami et al. ..... 123/195

FOREIGN PATENT DOCUMENTS 1954318 11/1970 Fed. Rep. of Germany ... 123/195 R
8405313 3/1984 Fed. Rep. of Germany ... 123/195 R
0110860 4/1989 Japan ..... 123/193 C

*Primary Examiner*—Willis R. Wolfe
*Assistant Examiner*—Thomas N. Moulis
*Attorney, Agent, or Firm*—Michael, Best & Friedrich

[57] ABSTRACT

An outboard motor comprising a lower unit, a propeller shaft rotatably supported by the lower unit and adapted to support a propeller, and an internal combustion engine supported by the lower unit and drivingly connected to the propeller shaft, the internal combustion engine including an engine block defining at least one cylinder and having a lifting hook integrally formed on the engine block.

12 Claims, 2 Drawing Sheets

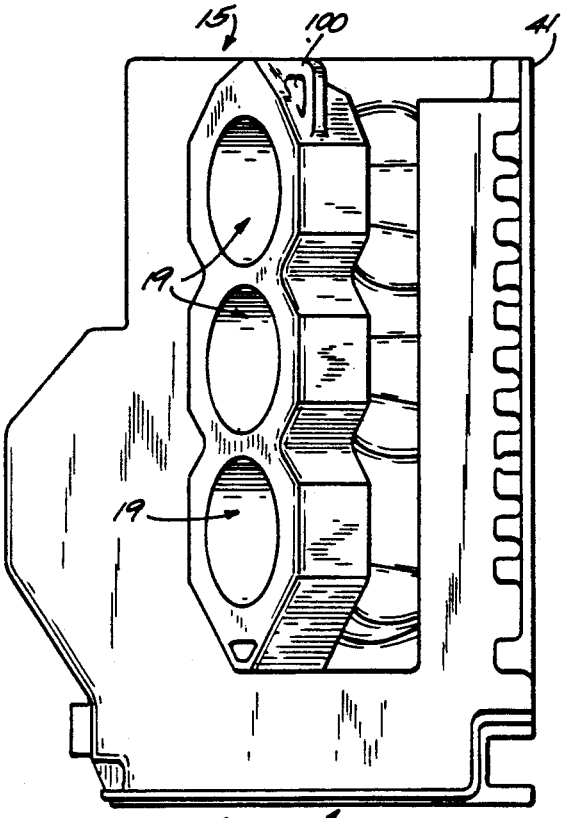
Fig. 4
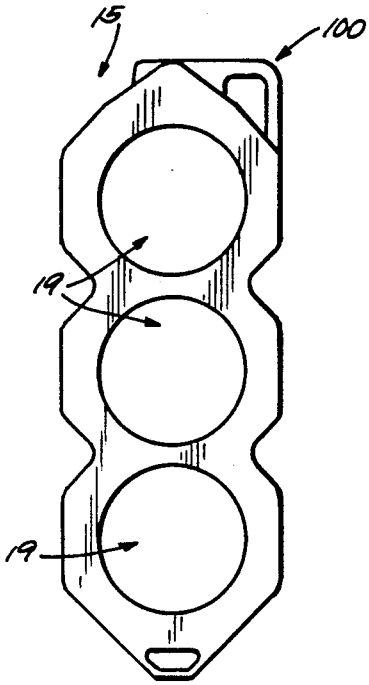
Fig. 6
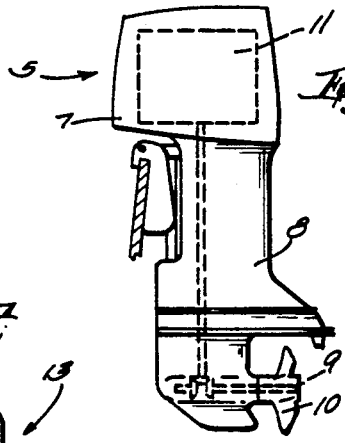
Fig. 1
Fig. 5
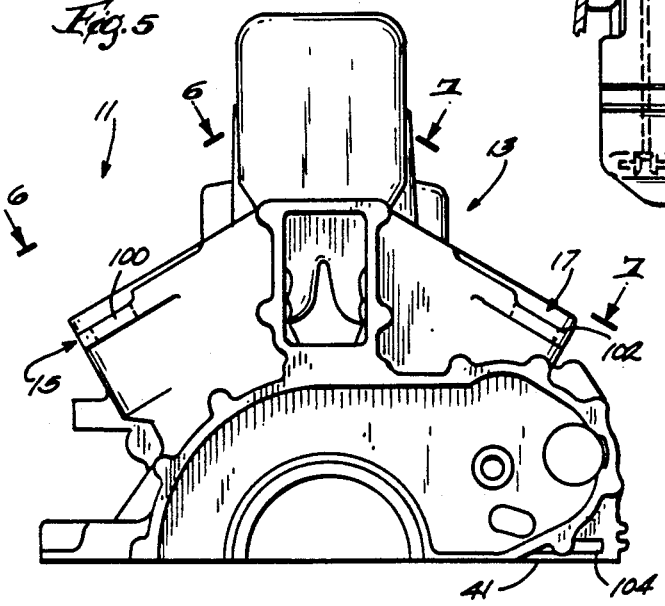
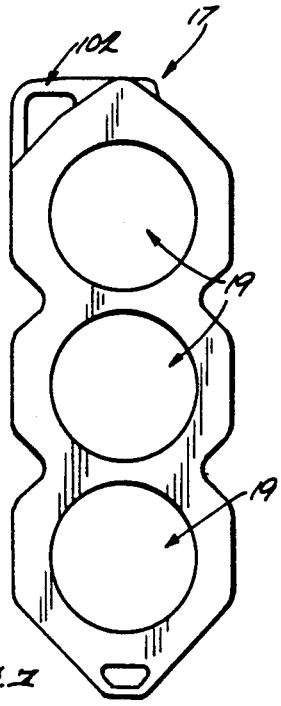
Fig. 7

INTEGRAL LIFTING HOOK FOR AN OUTBOARD ENGINE

BACKGROUND OF THE INVENTION

1. Field of the Invention

The invention relates to internal combustion engines, and more particularly to internal combustion engines having lifting hooks, and even more particularly to outboard motors including internal combustion engines having lifting hooks.

2. Background Information

In the handling of outboard motors, and of internal combustion engines in general, it is often desirable to suspend the outboard motor or engine by a chain or some similar member. In order to facilitate the suspension of outboard motors or internal combustion engines from a chain, it is known to provide various bracketry which can be fastened to the outboard motor or to the engine and to which the chain can be attached. For example, known suspension bracketry includes bracket plates which can be bolted to the engine block and which can thereafter be attached to a chain. In the case of outboard motors, it may be further desirable to suspend the outboard motor in an upright position, i.e., wherein the crankshaft of the engine extends generally vertically. Known suspension bracketry used to suspend an outboard motor in an upright position includes hooks which can be screwed into the upper end of the crankshaft, or which can be hooked onto a flywheel mounted on the upper end of the crankshaft. The hooks can then be attached to a chain to suspend the outboard motor in an upright position. Such known bracketry in the form of either plates or hooks requires mounting of the bracketry on the outboard motor o engine before the suspension thereof.

SUMMARY OF THE INVENTION

The invention provides an outboard motor comprising a lower unit, a propeller shaft rotatably supported by the lower unit and adapted to support a propeller, and an internal combustion engine supported by the lower unit and drivingly connected to the propeller shaft, the internal combustion engine including an engine block defining at least one cylinder and having a lifting hook integrally formed on the engine block.

The invention also provides an internal combustion engine comprising an engine block defining at least one cylinder and including at least one lifting hook integrally cast on the engine block.

The invention also provides an outboard motor comprising a lower unit, a propeller shaft rotatably supported by the lower unit and adapted to support a propeller, and an internal combustion engine supported by the lower unit and drivingly connected to the propeller shaft, the internal combustion engine including an engine block defining a first bank of cylinders, a second bank of cylinders and a manifold mounting surface, the engine block including three lifting hooks integrally cast on the engine block and defining a plane, one of the hooks being located adjacent the first bank of cylinders, another of the hooks being located adjacent the second bank of cylinders, and another of the lifting hooks being located adjacent the manifold mounting surface, and the internal combustion engine also including a crankshaft supported by the engine block for rotation about an axis extending substantially perpendicular to the plane.

It is an object of the invention to provide an outboard engine which can be lifted and suspended without ancillary bracketry.

It is another object of the invention to provide an outboard motor which can be suspended in an upright position without ancillary bracketry.

It may also be desirable to suspend only the engine block of an internal combustion engine. For example, it may be desirable to suspend the engine block for assembly of an internal combustion engine or of an outboard motor. For use of known suspension bracketry, partial assembly of the engine must be completed, i.e. the internal combustion engine must at least include a crankshaft, before the engine block can be suspended. Accordingly, it is a further object of the invention to provide an engine block which can be suspended without ancillary bracketry.

It is another specific object of the invention to provide an internal combustion engine having an engine block which can be suspended prior to assembly of the associated internal combustion engine and without ancillary bracketry.

DESCRIPTION OF THE DRAWINGS

FIG. 1 is an elevational view of an outboard motor embodying various features of the invention.

FIG. 4 is a side elevational view of the engine illustrated in FIG. 2.

FIG. 5 is a top plan view of the engine shown in FIG. 2.

FIG. 6 is a view taken along line 6—6 in FIG. 5.

FIG. 7 is a view taken along line 7—7 in FIG. 5.

Figure 2:
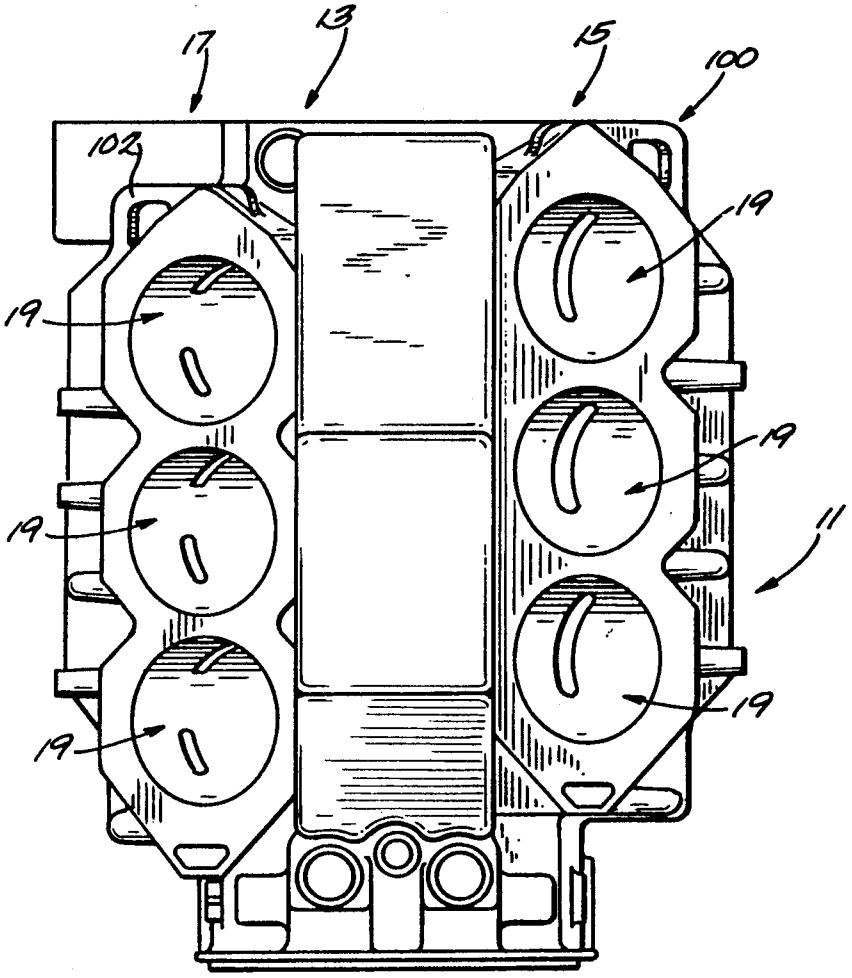
FIG. 2 is an elevational view of the engine block of the outboard motor shown in FIG. 1.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and the terminology used herein is for the purpose of description and should not be regarded as limiting.

GENERAL DESCRIPTION

Shown in the drawings is a marine propulsion device 5 in the form of an outboard motor 7 embodying various features of the invention. The outboard motor illustrated in FIG. 1 includes a lower unit 8 and a propeller shaft 9 rotatably supported by the lower unit 8 and adapted to support a propeller 10. The outboard motor 7 also includes an internal combustion engine 11 supported by the lower unit 8. Except as described below, the internal combustion engine 11 is substantially identical to the engine disclosed in U.S. Pat. application Ser. No. 316,153, which was filed on Feb. 27, 1989, now abandoned, and which is incorporated herein by reference, and the identifying numerals for the various features of the internal combustion engine described therein are adopted in this detailed description.

As shown in FIG. 2, the internal combustion engine 11 is a V-block internal combustion engine of the two-stroke type. The engine 11 includes a V-type block 13 including right and left cylinder banks 15, 17 each including a suitable number of cylinders 19. In the disclosed construction, each of the cylinder banks 15, 17 includes three aligned cylinders. Thus, the disclosed and preferred engine includes six cylinders 19. Also, the engine block 13 is preferably formed by casting, as by lost-foam casting.

More specifically, the engine block 13 includes (FIG. 3) a flat or planar exterior mounting surface 41 including a plurality of crankcase-defining cavities 53, one for each of the cylinders 19. The mounting surface 41 also includes a plurality of crankshaft-bearing recesses defined in part by respective semi-cylindrical walls 67.

The engine block 13 also includes combustion air passages 68 which extend from respective crankcases 57 to respective combustion air ports 69 in the manifold mounting surface 41. In the disclosed and preferred construction, each side of the manifold mounting surface 41 includes three combustion air ports 69 (one for each crankcase associated with one of the three cylinders 19 in the associated bank 15 or 17).

The engine also includes a crankshaft 70 which has opposite upper and lower ends 90, 91 and a longitudinal axis 92 extending generally vertically or between the opposite ends 90, 91. The crankshaft 70 is supported for rotation about the longitudinal axis 92 by suitable bearing means 93 located in the crankshaft bearing recesses 65.

The engine also includes a flywheel 94 supported by the upper end 90 of the crankshaft 70 above the upper end of the engine block 13, so that the flywheel 94 is on the upper end of the outboard motor 7.

Figure 3:
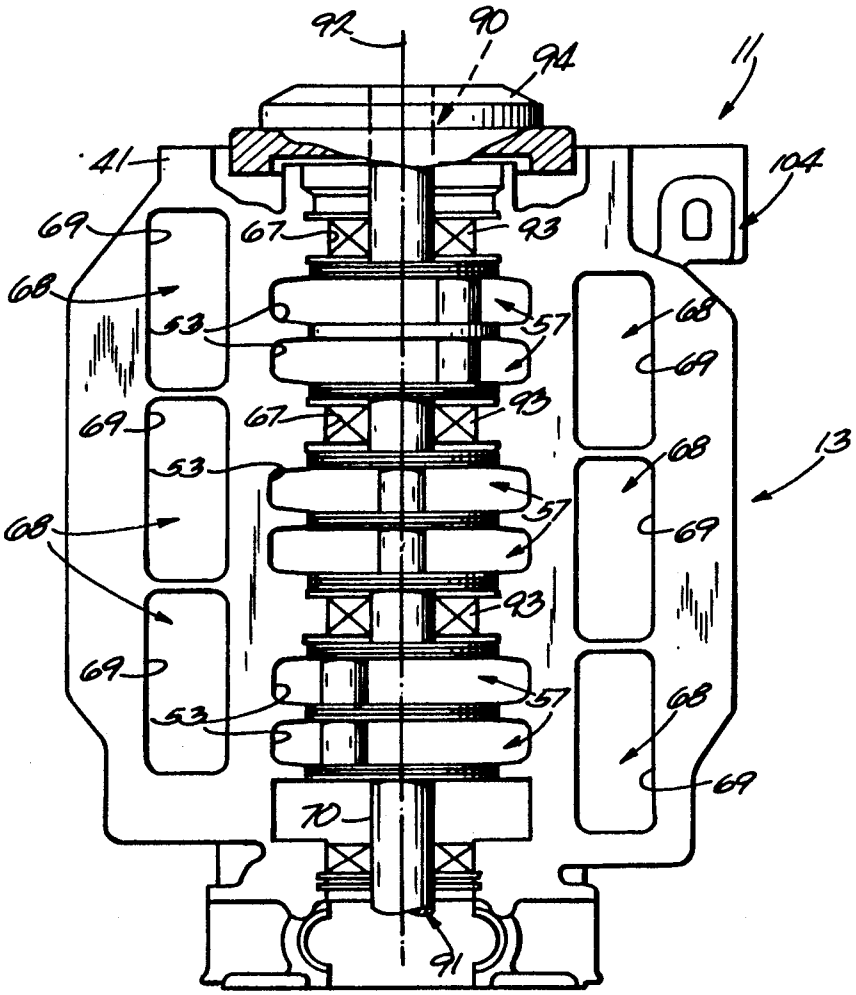
FIG. 3 is an elevational view, in partial cross-section, of the opposite side of the engine block shown in FIG. 2.

The internal combustion engine 11 also includes at least one lifting hook or eye integrally formed on the engine block 13. In the preferred embodiment, the engine block 13 includes (FIG. 5) three lifting hooks 100, 102, 104, each of which is integrally formed on the engine block 13. First and second lifting hooks 100, 102 are respectively located adjacent the uppermost cylinder 19 on the right and left cylinder banks 15, 17. As shown in FIG. 3, a third lifting hook 104 is located adjacent the upper end of the right side of the manifold mounting surface 41 and at a location or height such that the three hooks 100, 102, 104 define a substantially horizontal plane which extends substantially perpendicularly to the axis 92 of the crankshaft 70 and which intersects the axis 92 at a point substantially adjacent the flywheel 94.

The engine 11 also includes a plurality of pistons (not shown), each piston being housed by one of the six cylinders 19 and being connected to the crankshaft by a connecting rod (not shown). The engine 11 also includes a first intake manifold (not shown) supported on the right side of the manifold mounting surface 41 to communicate with the intake ports 69 of the right cylinder bank 15 and a second intake manifold (not shown) supported on the left side of the manifold mounting surface 41 to communicate with the intake ports 69 of the left cylinder bank 17. The engine 11 also includes a plurality of carburetors (not shown) communicating with the intake manifolds and thereby with the intake ports 69.

The location of the three lifting hooks 100, 102, 104 in a substantially horizontal plane at the flywheel end of the internal combustion engine 11 facilitates handling of the internal combustion engine 11 and the outboard motor 7. As mentioned above, the engine block 13 is preferably formed by a casting process, such as lost foam casting, and the lifting hooks 100, 102, 104 are formed on the engine block 13 as a result of the casting process. Thus, a chain or a similar suspending member can be attached to the lifting hooks 100, 102, 104 on the engine block 13 without the necessity of fastening any ancilliary bracketry to the engine block 13 and without prior assembly of the internal combustion engine 11.

Various of the features of the invention are set forth in the following claims.

We claim:

1. An outboard motor comprising a lower unit, a propeller shaft rotatably supported by said lower unit and adapted to support a propeller, and an internal combustion engine supported by said lower unit and drivingly connected to said propeller shaft, said internal combustion engine including an engine block defining at least one cylinder and having a lifting hook integrally formed on said engine block.

2. An outboard motor as set forth in claim 1 wherein said engine block includes first, second and third lifting hooks integrally formed on said engine block.

3. An outboard motor as set forth in claim 2 and further including a crankshaft rotatably supported by said engine block for rotation about an axis, and wherein said lifting hooks define a plane extending substantially perpendicular to said axis.

4. An outboard motor as set forth in claim 3 wherein said engine block defines a first bank of cylinders, a second bank of cylinders and a manifold mounting surface, and wherein said first hook is located adjacent said first cylinder bank, said second lifting hook is located adjacent said second cylinder bank, and said third lifting hook is located adjacent said manifold mounting surface.

5. An outboard motor as set forth in claim 4 wherein said crankshaft supports a flywheel, and wherein said plane intersects said axis at a point substantially adjacent said flywheel.

6. An internal combustion engine comprising an engine block defining at least one cylinder and including at least one lifting hook integrally cast on said engine block.

7. An internal combustion engine as set forth in claim 6 wherein said engine block includes at least three lifting hooks.

8. An internal combustion engine as set forth in claim 7 and further comprising a crankshaft rotatably supported by said engine block for rotation about an axis, and wherein said lifting hooks define a plane extending substantially perpendicular to said axis.

9. An internal combustion engine as set forth in claim 8 wherein said engine block includes a manifold mounting surface, and wherein one of said lifting hooks is located adjacent said manifold mounting surface.

10. An internal combustion engine as set forth in claim 9 wherein said engine block defines a first bank of cylinders and a second bank of cylinders, and wherein said other two lifting hooks are located adjacent said first and second cylinder banks.

11. An outboard motor comprising a lower unit, a propeller shaft rotatably supported by said lower unit and adapted to support a propeller, and an internal combustion engine supported by said lower unit and drivingly connected to said propeller shaft, said internal combustion engine including an engine block defining a first bank of cylinders, a second bank of cylinders and a manifold mounting surface, said engine block including three lifting hooks integrally cast on said engine block and defining a plane, one of said hooks being located adjacent said first bank of cylinders, another of said hooks being located adjacent said second bank of cylinders, and another of said lifting hooks being located adjacent said manifold mounting surface, and said internal combustion engine also including a crankshaft supported by said engine block for rotation about an axis extending substantially perpendicularly to said plane

12. An outboard motor as set forth in claim 11 and further comprising a flywheel supported by said crankshaft, and wherein said plane intersects said axis adjacent said flywheel.

* * * * *